US007735951B2

(12) United States Patent
Ahne et al.

(10) Patent No.: US 7,735,951 B2
(45) Date of Patent: Jun. 15, 2010

(54) ALIGNMENT METHOD FOR HAND-OPERATED PRINTER

(75) Inventors: Adam Jude Ahne, Lexington, KY (US); Edmund Hulin James, Lexington, KY (US); Randal Scott Williamson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 261 days.

(21) Appl. No.: 11/273,928

(22) Filed: Nov. 15, 2005

(65) Prior Publication Data

US 2007/0109339 A1 May 17, 2007

(51) Int. Cl.
*B41J 29/393* (2006.01)

(52) U.S. Cl. ..... 347/19; 347/9; 347/108

(58) Field of Classification Search ..... 347/2–3, 347/5, 9, 16, 19, 108; 400/88; 358/1.5
See application file for complete search history.

(56) References Cited

U.S. PATENT DOCUMENTS 4,675,700 A 6/1987 Nagira et al.
4,758,849 A 7/1988 Piatt et al.
4,819,083 A 4/1989 Kawai et al.
4,915,027 A 4/1990 Ishibashi et al.
4,916,638 A * 4/1990 Haselby et al. ..... 358/1.5
4,933,867 A 6/1990 Ishigaki
4,947,262 A 8/1990 Yajima et al.
4,949,391 A 8/1990 Faulkerson et al.
4,999,016 A 3/1991 Suzuki et al.
5,013,895 A 5/1991 Iggulden et al.
5,024,541 A 6/1991 Tsukada et al.
5,028,934 A 7/1991 Kasai et al.
5,052,832 A 10/1991 Akiyama et al.
5,063,451 A 11/1991 Yanagisawa et al.
5,093,675 A 3/1992 Koumura et al.
5,110,226 A 5/1992 Sherman et al.
5,111,216 A 5/1992 Richardson et al.
5,149,980 A 9/1992 Ertel et al.
5,160,943 A 11/1992 Pettigrew et al.
5,184,907 A 2/1993 Hamada et al.
5,186,558 A 2/1993 Sherman et al.
5,188,464 A 2/1993 Aaron
5,236,265 A 8/1993 Saito et al.
5,240,334 A 8/1993 Epstein et al.
5,262,804 A 11/1993 Petigrew et al.
5,267,800 A 12/1993 Petteruti et al.
5,308,173 A 5/1994 Amano et al.
5,311,208 A 5/1994 Burger et al.
5,312,196 A 5/1994 Hock et al.
5,344,248 A 9/1994 Schoon et al.
5,355,146 A 10/1994 Chiu et al.
5,446,559 A 8/1995 Birk
5,449,238 A 9/1995 Pham et al.

(Continued)

FOREIGN PATENT DOCUMENTS

SE 103334 10/1941

(Continued)

*Primary Examiner*—Lam S Nguyen

(57) ABSTRACT

A method of printing multiple swaths with a hand-operated printer having a target sight includes printing at least one alignment mark for a subsequent print swath during a printing of a current print swath; and aligning the target sight with the alignment mark prior to beginning printing of the subsequent print swath.

7 Claims, 8 Drawing Sheets

U.S. PATENT DOCUMENTS 5,462,375 A 10/1995 Isobe et al.
5,475,403 A 12/1995 Havlovick et al.
5,503,483 A 4/1996 Petteruti et al.
5,520,470 A 5/1996 Willett
5,578,813 A 11/1996 Allen et al.
5,650,820 A 7/1997 Sekine et al.
5,664,139 A 9/1997 Spurlock
5,685,651 A 11/1997 Hayman et al.
5,686,720 A 11/1997 Tullis
5,729,008 A 3/1998 Blalock et al.
5,786,804 A 7/1998 Gordon
5,806,993 A 9/1998 Petterutti et al.
5,816,718 A 10/1998 Poole
5,825,044 A 10/1998 Allen et al.
5,829,893 A 11/1998 Kinoshita et al.
5,842,793 A 12/1998 Katayama et al.
5,848,849 A 12/1998 Kishi et al.
5,850,243 A 12/1998 Kinoshita et al.
5,853,251 A 12/1998 Imai
5,887,992 A 3/1999 Yamanashi
5,892,523 A 4/1999 Tanaka et al.
5,927,827 A 7/1999 Reuter et al.
5,927,872 A 7/1999 Yamada
5,953,497 A 9/1999 Kokubo et al.
5,984,455 A 11/1999 Anderson
5,988,900 A 11/1999 Bobry
5,997,193 A 12/1999 Petterutti et al.
6,004,053 A 12/1999 Petteruti et al.
6,005,681 A 12/1999 Pollard
6,010,257 A 1/2000 Petteruti et al.
6,017,112 A 1/2000 Anderson et al.
6,026,686 A 2/2000 Hattori et al.
6,076,910 A 6/2000 Anderson
6,158,907 A 12/2000 Silverbrook et al.
6,195,475 B1 2/2001 Beausoleil, Jr. et al.
6,203,221 B1 3/2001 Tomasik et al.
6,246,423 B1 6/2001 Suzuki et al.
6,249,360 B1 6/2001 Pollard et al.
6,259,826 B1 7/2001 Pollard et al.
6,270,187 B1 8/2001 Murcia et al.
6,270,271 B1 8/2001 Fujiwara
6,338,555 B1 1/2002 Hirose
6,347,897 B2 2/2002 Huggins et al.
6,357,939 B1 3/2002 Baron
6,373,995 B1 4/2002 Mioore
6,394,674 B2 5/2002 Huggins et al.
6,499,840 B2 12/2002 Day et al.
6,503,005 B1 1/2003 Cockerill et al.
6,533,476 B2 3/2003 Hamisch, Jr. et al.
6,543,893 B2 4/2003 Desormeaux
6,553,459 B1 4/2003 Silverbrook et al.
6,572,290 B2 6/2003 McCleave et al.
6,604,874 B2 8/2003 Carriere et al.
6,607,316 B1 8/2003 Petteruti et al.
6,609,844 B1 8/2003 Petteruti et al.
6,623,191 B2 9/2003 Huggins et al.
6,626,597 B2 9/2003 Fujiwara
6,641,313 B2 11/2003 Bobry
6,648,528 B2 11/2003 Hardisty et al.
6,652,090 B2 11/2003 Silverbrook
6,674,543 B2 1/2004 Day et al.
6,769,360 B2 8/2004 Walling
6,773,177 B2 8/2004 Denoue et al.
6,846,119 B2 1/2005 Walling
6,942,335 B2 9/2005 Trent
6,952,880 B2 10/2005 Saksa
2001/0019349 A1 9/2001 Kawakami
2001/0022914 A1 9/2001 Iura et al.
2001/0024586 A1 9/2001 Day et al.
2002/0018108 A1* 2/2002 Day et al. ..... 347/108
2002/0033871 A1 3/2002 Kaiser
2002/0090241 A1 7/2002 Fujiwara
2002/0127041 A1 9/2002 Huggins et al.
2002/0154186 A1 10/2002 Matsumoto
2003/0031494 A1 2/2003 Cockerill et al.
2003/0063938 A1 4/2003 Hardisty et al.
2003/0117456 A1 6/2003 Silverbrook et al.
2004/0009024 A1 1/2004 Hardisty et al.
2004/0014468 A1 1/2004 Walling
2004/0018035 A1 1/2004 Petteruti et al.
2005/0018032 A1 1/2005 Walling
2005/0018033 A1 1/2005 Walling
2006/0012660 A1 1/2006 Dagborn
2006/0050131 A1 3/2006 Breton
2006/0061647 A1 3/2006 Breton
2006/0165460 A1 7/2006 Breton

FOREIGN PATENT DOCUMENTS

SE 522047 1/2004
SE 527474 C2 3/2006
WO WO 2004056576 A1 7/2004
WO WO 2004056577 A1 8/2004
WO WO 2004088576 A1 10/2004
WO WO 2004103712 A1 12/2004

* cited by examiner

ALIGNMENT METHOD FOR HAND-OPERATED PRINTER

BACKGROUND OF THE INVENTION

1. Field of the Invention

The present invention relates to a hand-operated printer, and, more particularly, to a method of printing multiple swaths with a hand-operated printer.

2. Description of the Related Art

A hand-operated printer is a printer that typically does not include a drive mechanism for positioning a printhead relative to the print medium, such as paper. An optical encoder typically is used to provide position feedback of relative motion between the hand-operated printer and the print medium. Thus, the hand-operated printer only senses movement along one axis and is designed to print a single swath having a height corresponding to the height of the printhead. It has not been practical to use such a printer for printing paragraphs of text, or graphics, such as for example, maps.

SUMMARY OF THE INVENTION

The invention, in one exemplary embodiment, is directed to a method of printing multiple swaths with a hand-operated printer having a target sight. The method includes printing at least one alignment mark for a subsequent print swath during a printing of a current print swath; and aligning the target sight with the alignment mark prior to beginning printing of the subsequent print swath.

The invention, in another exemplary embodiment, is directed to a hand-operated printer. The hand-operated printer includes a body. A printhead is mounted to the body. At least one target sight is mounted to the body. A controller operates the printhead to print at least one alignment mark for a subsequent print swath during a printing of a current print swath to facilitate a manual alignment of at least one target sight with the alignment mark prior to beginning printing of the subsequent print swath.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
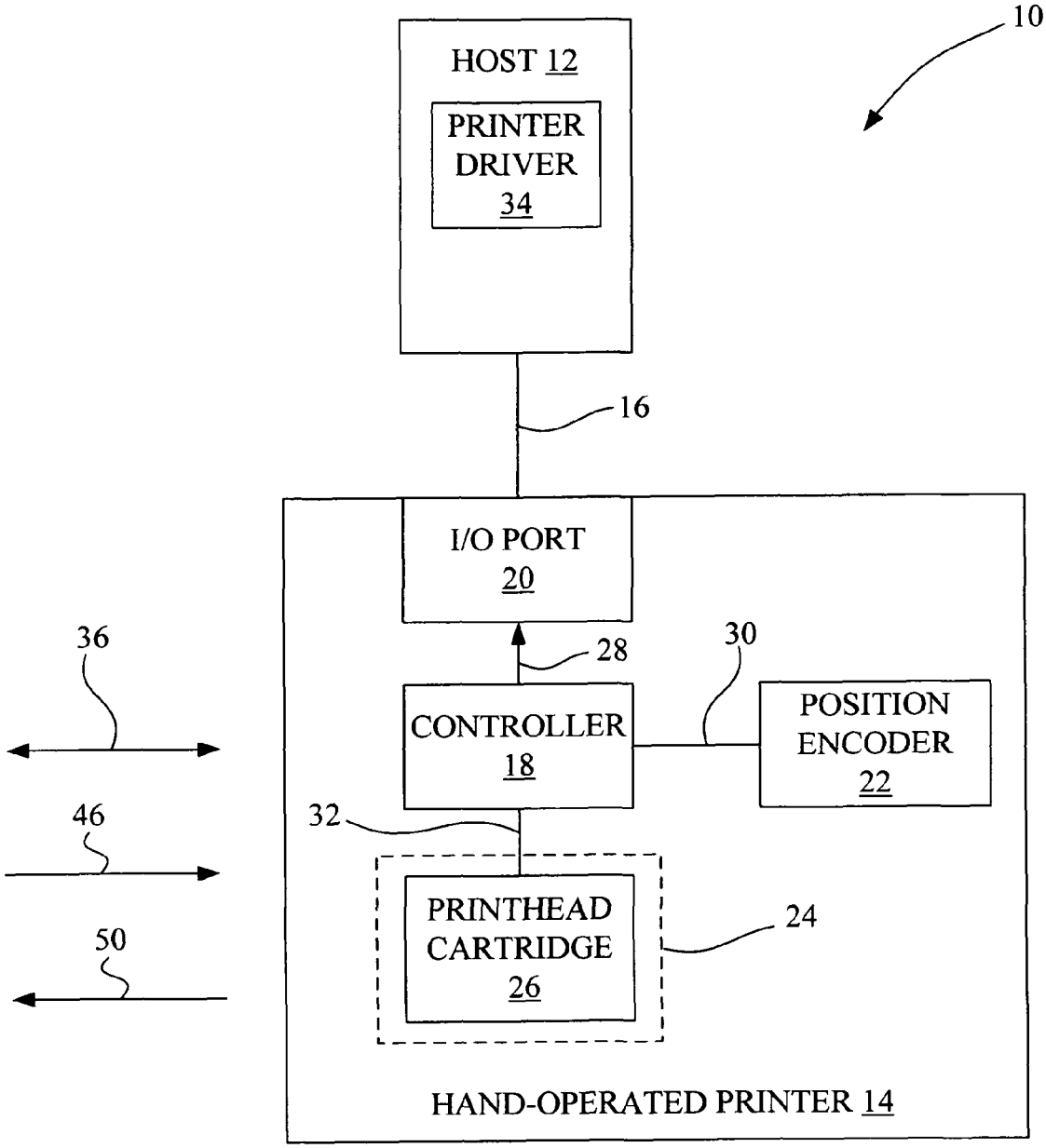
FIG. 1 is a general diagrammatic representation of an imaging system including a host and a hand-operated printer.

Referring now to the drawings and particularly to FIG. 1, there is shown a general diagrammatic representation of an imaging system 10 including a host 12 and a hand-operated printer 14. In the following paragraphs, a hand-operated printer 14 is described that communicates with a host 12 via a communications link 16. But one of ordinary skill in the art will readily recognize that the present invention has equal applicability with a stand-along hand-operated printer in which all of the components and functionality described as residing in or attributed to the host can exist in the hand-held printer itself.

As used herein, the term "communications link" generally refers to structure that facilitates electronic communication between two components, and may operate using wired or wireless technology. Accordingly, communications link 16 may be, for example, a direct electrical wired connection, a direct wireless connection (e.g., infrared or r.f.), or a network connection (wired or wireless), such as for example, an Ethernet local area network (LAN) or a wireless networking standard, such as IEEE 802.11.

Hand-operated printer 14 may be, for example, a hand-operated ink jet printer, and may include a controller 18, an input/output (I/O) port 20, a position encoder 22, and a fixed-position cartridge receptacle 24 for receiving a printhead cartridge 26. Hand-operated printer 14 is configured to be moved along a print medium, such as paper, with a user providing the motive force to provide movement of the hand-operated printer 14, and in turn printhead cartridge 26, relative to a printing surface of the print medium.

Controller 18 includes a processor unit and associated memory, and may be formed as one or more Application Specific Integrated Circuits (ASIC). Although controller 18 is depicted as being located in hand-operated printer 14, alternatively, it is contemplated that all or a portion of controller 18 may reside in host 12. Controller 18 is communicatively coupled to I/O port 20 via communications link 28, to position encoder 22 via a communications link 30, and to printhead cartridge 26 via a communications link 32. Controller 18 serves to process print data received from host 12 via I/O port 20 during printing.

Host 12 may be, for example, a personal computer, including memory, an input device, such as a keyboard, and a display monitor. Host 12 further includes a processor, input/output (I/O) interfaces, memory, such as RAM, ROM, NVRAM, and at least one mass data storage device, such as a hard drive, a CD-ROM and/or a DVD unit. During operation, host 12 includes in its memory a software program including program instructions that function as a printer driver 34. Printer driver 34 is in communication with controller 18 of hand-operated printer 14 via communications link 16 and I/O port 20. Printer driver 34 facilitates communication between hand-operated printer 14 and host 12, and may provide formatted print data to hand-operated printer 14. Although printer driver 34 is disclosed as residing host 12, it is contemplated that, alternatively, all or a portion of printer driver 34 may be located in controller 18 of hand-operated printer 14.

In one embodiment of hand-operated printer 14, position encoder 22 may be an optical encoder similar to that used on an optical mouse, and may be configured to only sense movement along a scan axis 36. Alternatively, in wheeled embodiments of hand-operated printer 14 (see, e.g., FIG. 6), position encoder 22 may be a rotary encoder coupled to at least one of the wheels of hand-operated printer 14. As a further alternative, wherein hand-operated printer 14 includes a mechanical guide member (see, e.g., FIG. 8), position encoder 22 may be in the form of an elongate encoder strip similar to that used on conventional ink jet printers.

Cartridge receptacle 24 is configured to provide mechanical and electrical mounting of at least one printhead cartridge 26 to hand-operated printer 14. Cartridge receptacle 24 holds printhead cartridge 26 in a fixed position relative to hand-operated printer 14.

Figure 2:
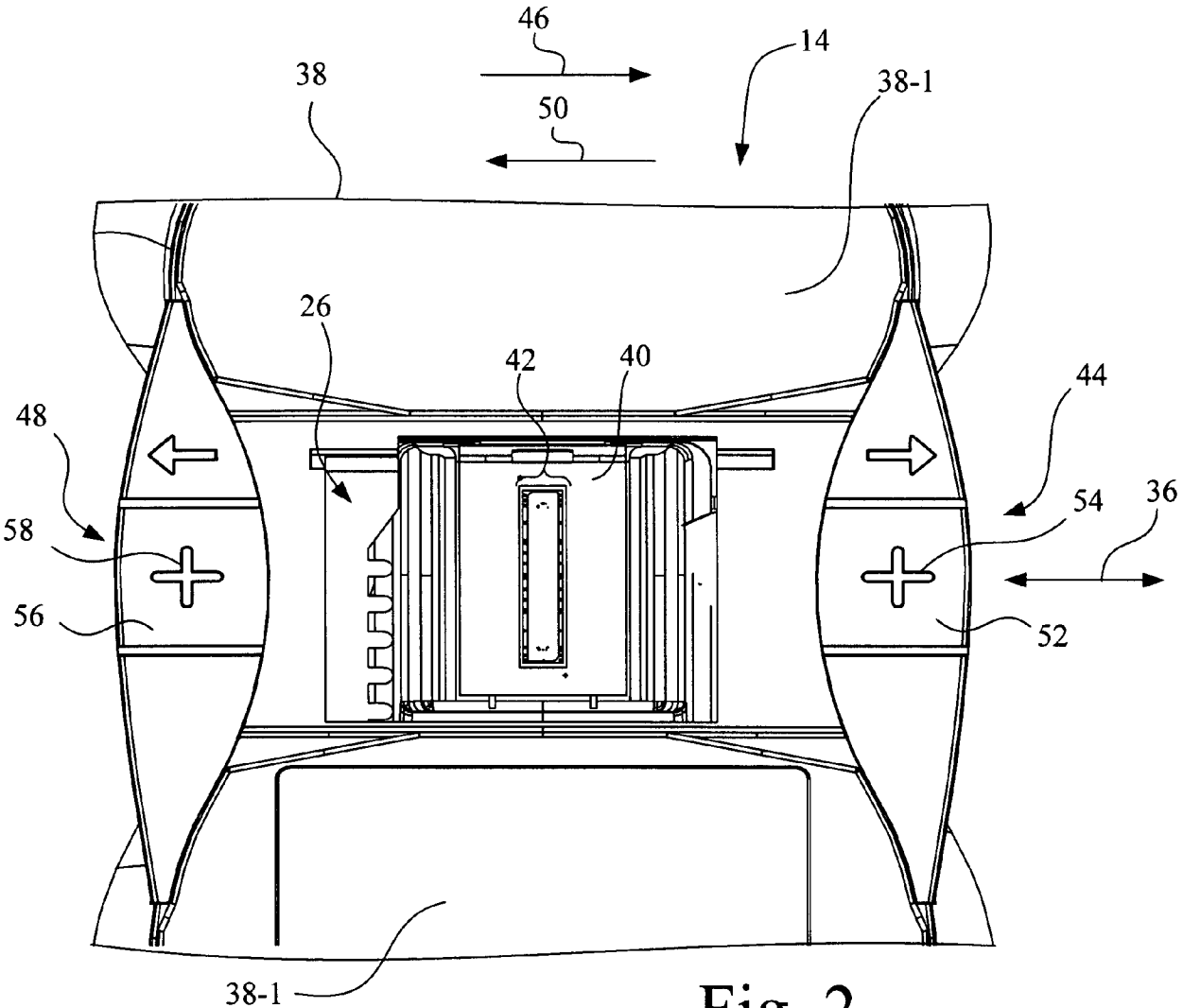
FIG. 2 is a bottom view of an embodiment of the hand-operated printer of FIG. 1.

FIG. 2 is a bottom view of an embodiment of hand-operated printer 14. Hand-operated printer 14 includes a body 38. Controller 18, input/output (I/O) port 20, position encoder 22, and cartridge receptacle 24 are mounted to body 38. Cartridge receptacle 24 may be formed in body 38 for receiving and mounting at least one printhead cartridge 26 having a printhead 40 including an array of ink jetting nozzles 42. Printhead cartridge 26 further includes a supply of ink. Body 38 is configured with a smooth surface 38-1 that contacts the print medium, e.g., paper, to provide the desired spacing between printhead 40 and the print medium.

In the present embodiment, as shown in FIG. 2, a first target sight 44 is positioned to the right of printhead cartridge 26 to facilitate alignment of a scan of hand-operated printer 14 during scanning in a first scan direction 46, e.g., a left-to-right direction. A second target sight 48, which may be optional, is positioned to the left of printhead cartridge 26 to facilitate alignment of a scan of hand-operated printer 14 during scanning in a second scan direction 50, e.g., a right-to-left direction. In the example above, the use of the terms "left-to-right direction" and "right-to-left" assumes that the intended scan path is substantially horizontal. However, those skilled in the art will recognize that the scan path may be of any orientation, e.g., including vertical, diagonal or curved, with respect to the print media.

Target sight 44 has a corresponding transparent region 52 formed in body 38, and has a reticle 54 providing orientation aspects in two dimensions. In one embodiment, for example, reticle 54 may be a cross-shaped reticle providing orientation aspects in perpendicular directions. Target sight 48 has a corresponding transparent region 56 formed in body 38, and has a reticle 58 providing orientation aspects in two dimensions. For example, reticle 58 also may be a cross-shaped reticle providing orientation aspects in perpendicular directions. Reticles 54 and 58 are shown substantially vertically centered with respect to the height of printhead 40. However, those skilled in the art will recognize that the vertical and horizontal locations of reticles 54 and 58 with respect to printhead 40 may be changed, as desired, to accommodate, for example, different maximum swath spacings. For example, reticles 54 and 58 may be vertically aligned with the upper nozzles, or an upper nozzle section, of printhead 40.

Figure 3:
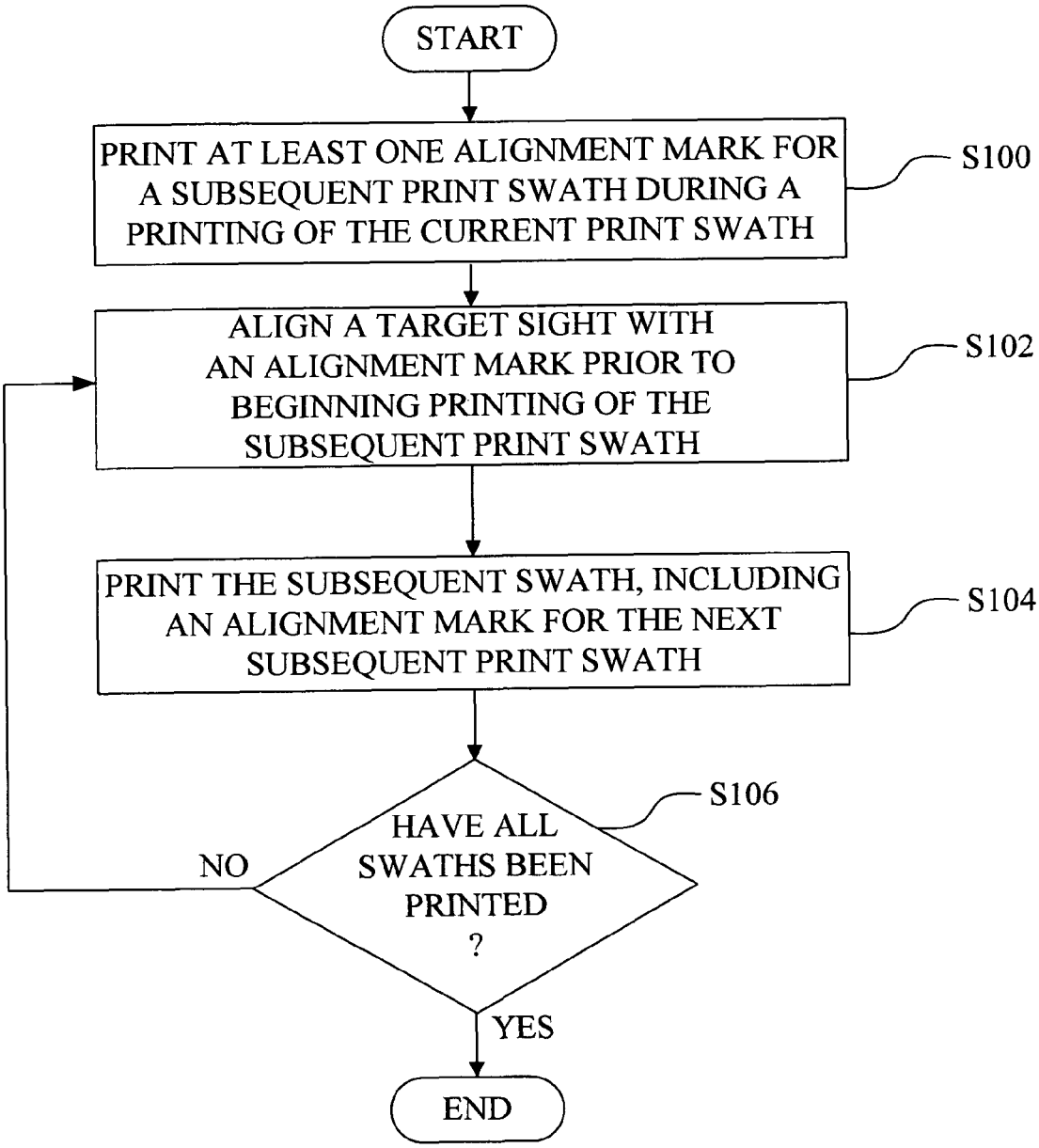
FIG. 3 is a flowchart of a method of printing multiple swaths with a hand-operated printer, according to an embodiment of the present invention.

FIG. 3 is a flowchart of a method of printing multiple swaths with a hand-operated printer, according to an embodiment of the present invention.

Figure 4:
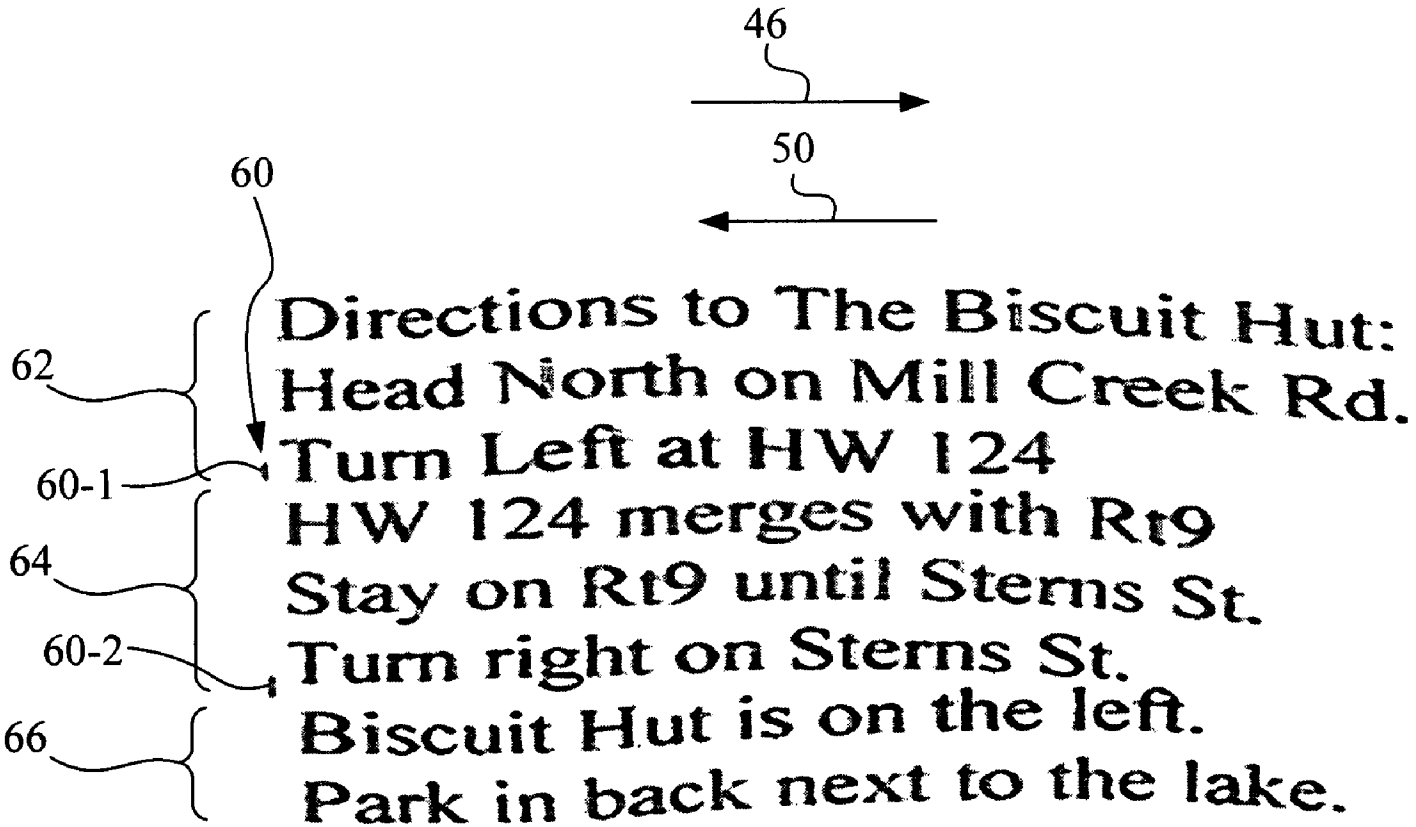
FIG. 4 depicts a plurality of print swaths, each including an alignment mark in the form of a tick mark formed in accordance with an embodiment of the present invention.

At step S100, and referring to the example of FIG. 4, at least one alignment mark 60 for a subsequent print swath, e.g., print swath 64, is printed during a printing of the current print swath, e.g., print swath 62. Each alignment mark may be printed at a beginning or at an end of the current print swath, or both if desired. In the example of FIG. 4, each alignment mark 60 is a vertical tick mark, although other configurations of the alignment mark may be used, such as for example, a dot, a small circle, or other marker shape, as desired.

For example, controller 18 operates printhead 40 to print at least one alignment mark 60 during the current print swath 62 for use as a target in printing a subsequent print swath 64. For example, a print data header associated with print swath 62 may include alignment mark data for printing an alignment mark 60-1 for use as a target in printing print swath 64. In the example of FIG. 4, print swath 62 includes alignment mark 60-1 and three lines of text.

At step S102, a target sight, such as one of target sight 44 and target sight 48, is aligned with alignment mark 60 prior to beginning printing of the subsequent print swath 64.

For example, a user manually positions hand-operated printer 14 to align a respective one of target sight 44 and target sight 48 with the respective alignment mark 60-1 in printing the next print swath 64. In other words, for example, a user may manually align reticle 54 of target sight 44 with a corresponding alignment mark 60, e.g., alignment mark 60-1, printed during a previous print swath, e.g., swath 62, prior to beginning printing of the next print swath, e.g., swath 64.

At step S104, subsequent swath 64 is printed. In the example of FIG. 4, print swath 64 contains alignment mark 60-2 followed by the next three lines of text. In doing so, in this example, print swath 64, preceded by alignment mark 60-2, is printed in relation to current print swath 62. Controller 18 operates printhead 40 to print the at least one alignment mark 60, e.g., alignment mark 60-2, during print swath 64 for use as a target in printing a subsequent print swath 66. For example, a print data header associated with print swath 64 may include alignment mark data for printing alignment mark 60-2 for use as a target in printing the next print swath 66.

At step S106, a determination is made as to whether all swaths have been printed.

If the determination is NO, then the process returns to sep S102. For example, the user may manually align reticle 54 of target sight 44 with a corresponding alignment mark 60, e.g., alignment mark 60-2, and then print swath 66 is printed, which in this example contains the last two lines.

If the determination is YES, then the process ends.

In other words, steps S102 and S104 are repeated until all swaths are printed.

In the method described above, an initial vertical spacing between vertically adjacent alignment marks is selected. For example, vertically adjacent alignment marks 60 may be positioned to provide a uniform distance between vertically adjacent swaths. This process ensures that each swath starts at the same horizontal position and places the next swath at the correct vertical position, thereby permitting a user to create prints that are taller than the height of printhead 40 by aligning consecutive swaths to each other. As a result of facilitating the printing of multiple adjacent swaths, a user is not limited to printing a single swath having a height corresponding to that of the height of printhead 40.

As an alternative to the example described above with respect to FIG. 4, it is contemplated that printer driver 34 may place swath transitions on rows that are free of printing and move alignment mark 60 vertically to create variable height swaths. For example, the vertically adjacent alignment marks 60 may be positioned to provide a variable distance between vertically adjacent swaths. In other words, if alignment mark 60 is moved up by an amount in the current swath, the next swath will be moved up a corresponding amount.

Figure 5:
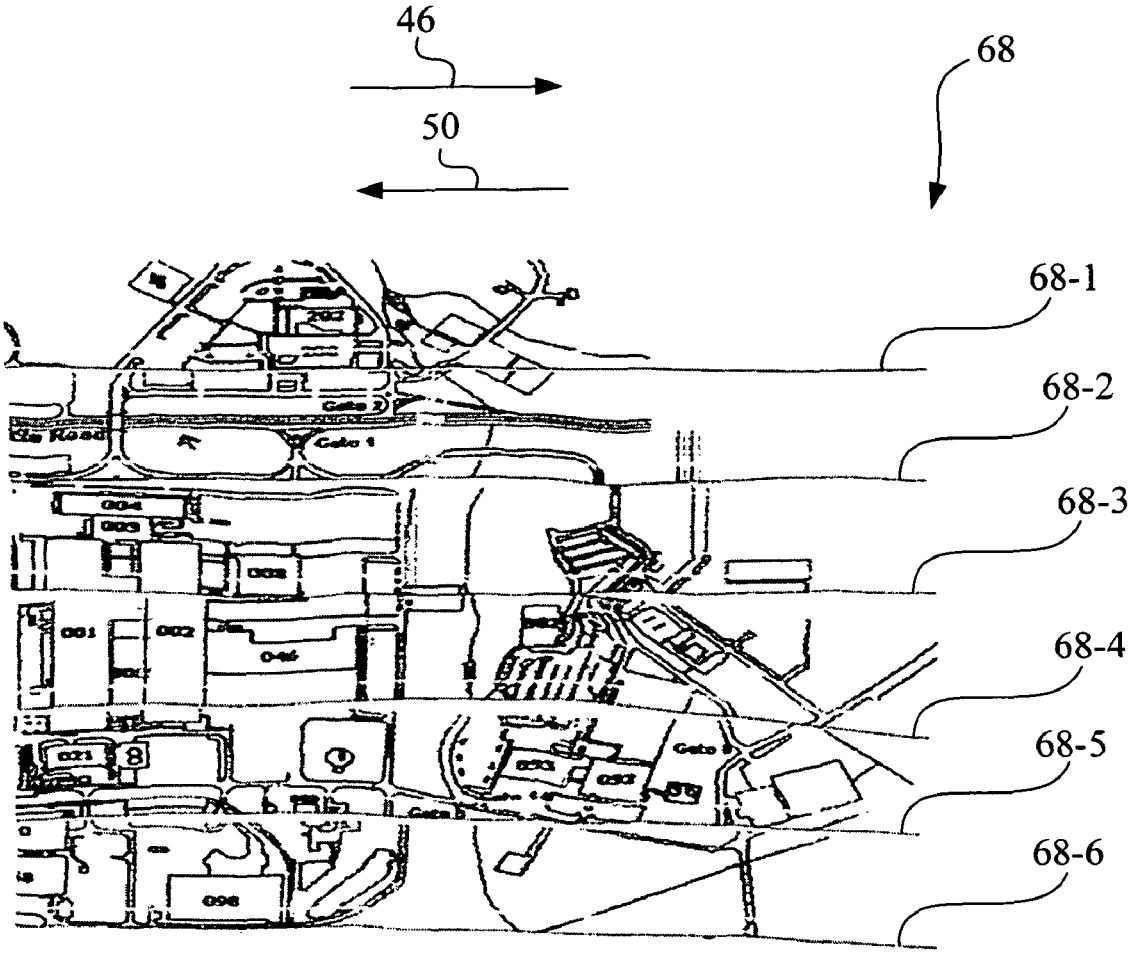
FIG. 5 depicts a plurality of print swaths, each including an alignment mark in the form of a line formed in accordance with an embodiment of the present invention.

As an exemplary alternative to the alignment mark 60 in the form of a tick mark as in the example described above with respect to FIG. 4, as illustrated in FIG. 5. printer driver 34 may add a line 68 (individually identified in FIG. 5 as lines 68-1, 68-2, 68-3, 68-4, 68-5 and 68-6) to the bottom of each swath to guide the user as the user prints the next swath. This will help the user to keep the swaths aligned vertically throughout the entire swath by aligning one or both of reticles 54, 58 of respective target sights 44, 48 to the respective line 68. In the example shown in FIG. 5, a solid row of pixels may be used in printing each line 68-1, 68-2, 68-3, 68-4, 68-5 and 68-6. However, those skilled in the art will recognize that a dashed line, dotted line, or other less noticeable patterns may also be used.

Figure 6:
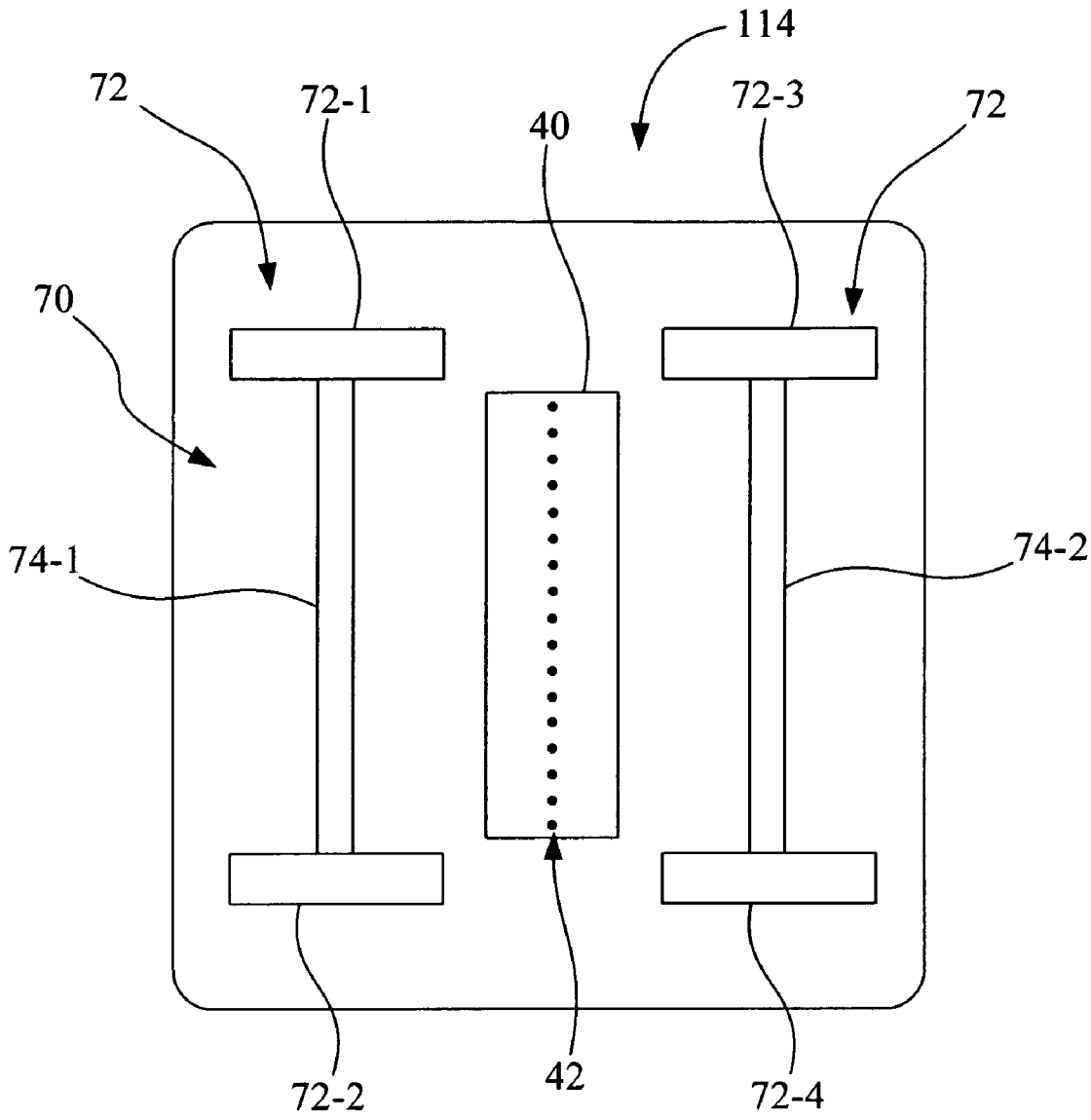
FIG. 6 is a bottom view of another embodiment of the hand-operated printer of FIG. 1, including a wheel assembly.

As exemplified in FIGS. 4 and 5, some users may find it difficult to move hand-operated printer 14 in a straight line, even when tracking a line as in FIG. 5. FIG. 6 shows an optional wheel assembly 70 that is configured to assist the user in sweeping straight lines.

In FIG. 6, there is shown a hand-operated printer 114, which is substantially identical to hand-operated printer 14, except for the inclusion of wheel assembly 70 including a plurality of wheels 72 that are arranged to enable hand-operated printer 114 to move freely in a swath printing direction of the current swath, e.g., first scan direction 46 or second scan direction 50, but resist movement in other directions. The wheels may be in the form of rubber tires. In the example of FIG. 6, wheels 72-1 and 72-2 are connected by an axle 74-1, and the wheels 72-3 and 72-4 are connected by an axle 74-2. Axle 74-1 and axle 74-2 are positioned to be parallel with each other, and parallel to the row of ink jetting nozzles 42. Accordingly, hand-operated printer 114 will roll easily when pushed in one of scan direction 46 and scan direction 50, and will resist any motion that is at a non-zero angle with respect to the plurality of wheels 72, i.e., any motion that is non-perpendicular to axles 74-1, 74-2. This will assist the user in making straighter swaths across the media. Note that two or three wheels may be used instead of four wheels, if desired.

Figure 7:
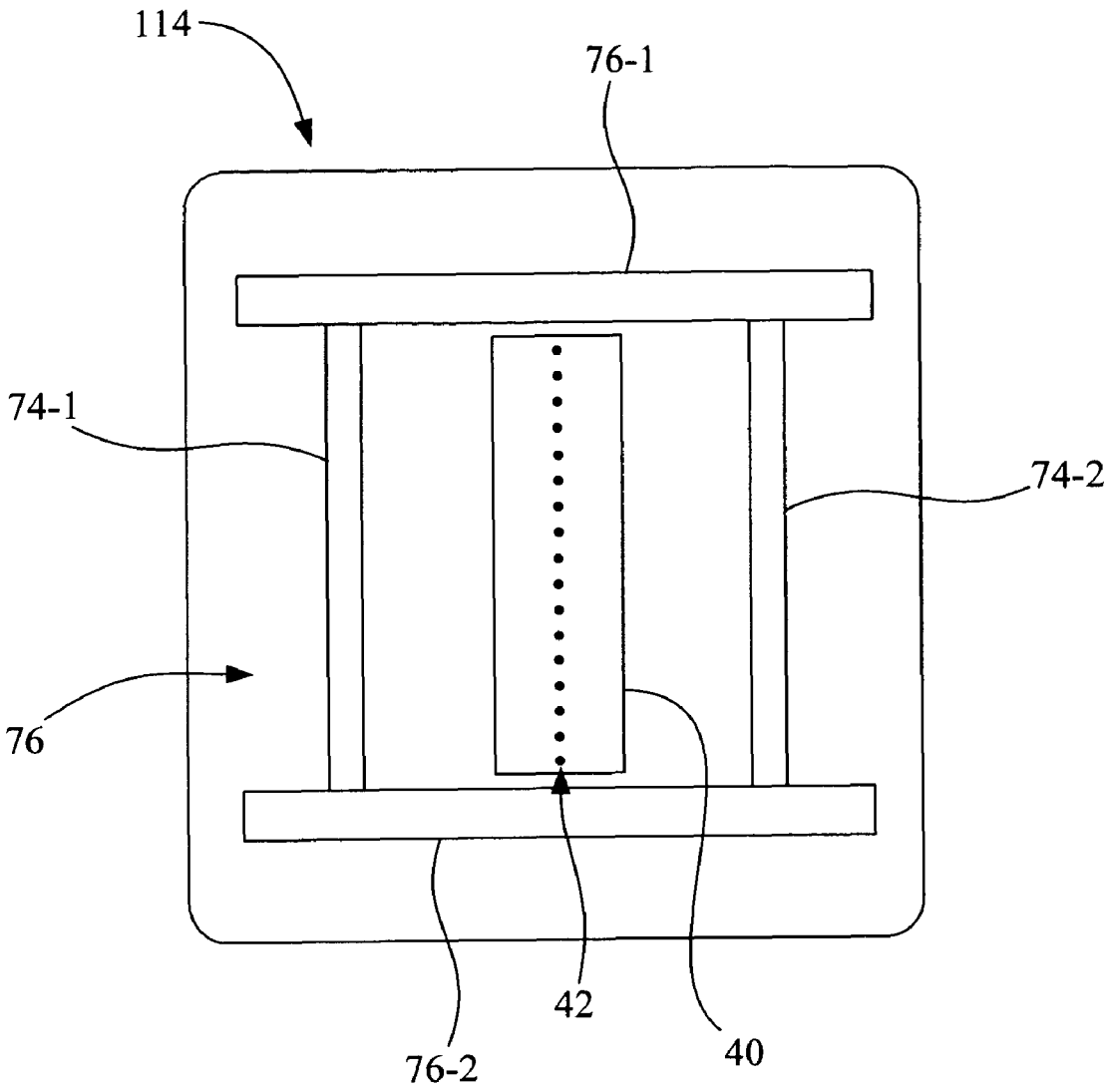
FIG. 7 is a bottom view of another embodiment of the hand-operated printer of FIG. 1, including a track-type belt assembly.

As an alternative to the four wheel configuration of FIG. 6, it is contemplated that a track-type belt assembly 76 may be used, as illustrated in FIG. 7. For example, belt 76-1 may be positioned to replace wheels 72-1 and 72-3, and belt 76-2 may be positioned to replace wheels 72-2 and 72-4. Alternatively, for example, a single belt may be used, if desired.

Figure 8:
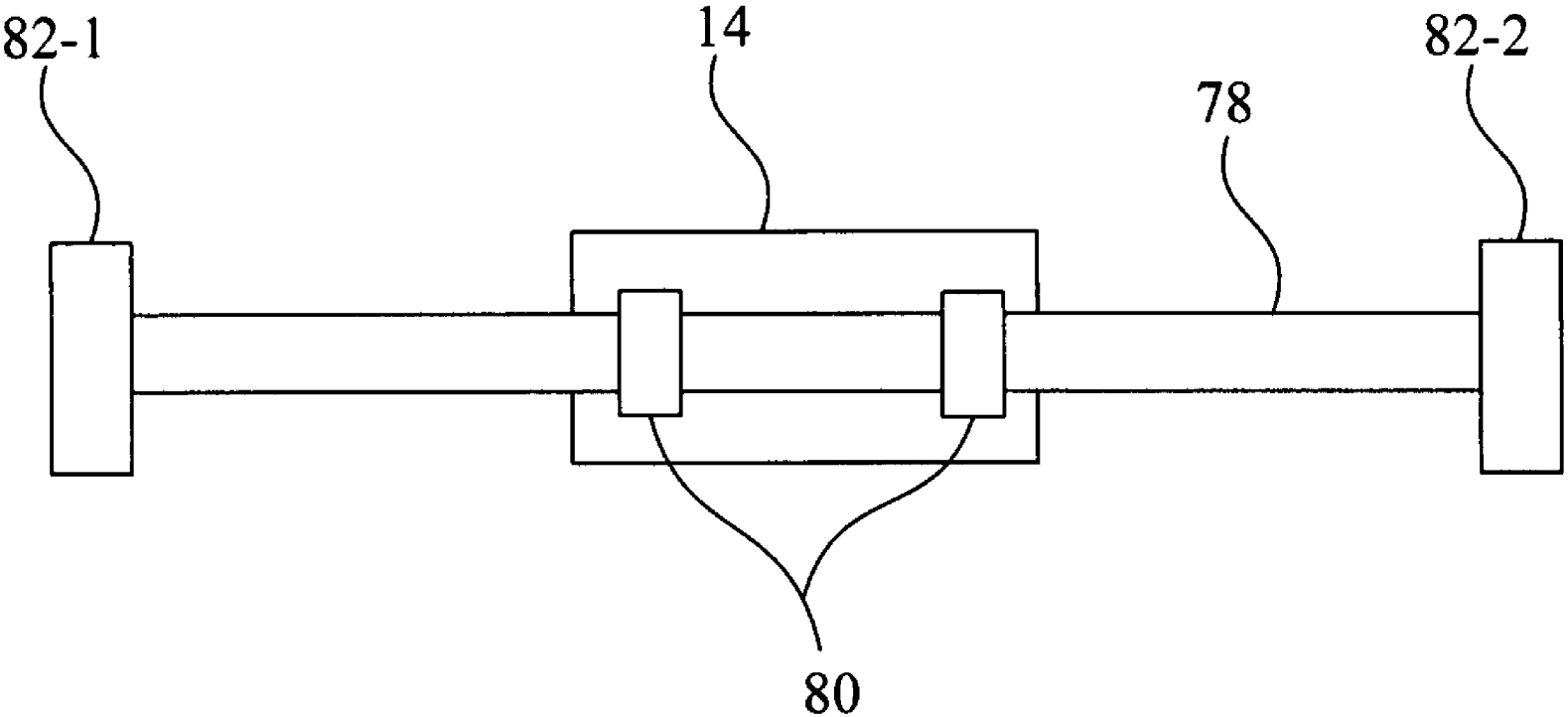
FIG. 8 is a diagrammatic representation of another embodiment of the hand-operated printer of FIG. 1, including an elongated guide for guiding the hand-operated printer.

As a further alternative, as illustrated in FIG. 8, hand-operated printer 14 may be pushed against an elongated guide 78, such as a straight rod, ruler or other straight guide member. In this embodiment, elongated guide 78 defines scan axis 36. If desired, hand-operated printer 14 may be slidably mounted to elongated guide 78 via a pair of bearing mounts 80. Also, elongated guide 78 may be mounted to tires 82-1, 82-2 to allow it to freely roll vertically down the page, and to resist elongated guide 78 from moving horizontally. One advantage of such a captive guide is that the start and stop position for each swath can be aligned by stops between the guide and printer. Also bi-directional printing may be achieved with greater ease.

During operation, hand-operated printer 14 is moved along scan axis 36 of elongated guide 78 for the current print swath. Then, elongated guide 78 is moved in a direction substantially perpendicular to scan axis 36 to accommodate a positioning of hand-operated printer 14 to print the subsequent print swath, and the process is repeated until all swaths are printed.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hand-operated printer, comprising:

a body;

a printhead mounted to said body;

at least one transparent target sight mounted to said body: and a controller mounted to said body, said controller operating said printhead to print at least one alignment mark for a subsequent print swath during a printing of a current print swath to facilitate a visual alignment of at least one transparent target sight with said alignment mark prior to beginning printing of said subsequent print swath with said controller printing a subsequent alignment mark during printing of said subsequent print swath wherein said subsequent alignment mark is moved vertically with respect to said at least one alignment mark of said current print swath to create a variable height swath, wherein said at least one transparent target sight comprises:

a first transparent target sight positioned to facilitate manual alignment of said subsequent scan of said hand-operated printer in a first direction; and a second transparent target sight positioned to facilitate manual alignment of a next subsequent scan of said hand-operated printer in a second direction opposite to said first direction.

2. The printer of claim 1, wherein each said target sight is a transparent region formed in said body having a reticle providing orientation aspects in two dimensions.

3. The printer of claim 2, wherein each said target sight is a transparent region formed in said body having a cross-shaped reticle.

4. The printer of claim 1, further comprising a plurality of wheels arranged to enable said hand-operated printer to move freely in a swath printing direction of said current swath but resist movement in other directions.

5. The printer of claim 4, wherein at least one of said plurality of wheels is coupled to a position encoder.

6. The printer of claim 1, further comprising at least one belt arranged to enable said hand-operated printer to move freely in a swath printing direction of said current swath but resist movement in other directions.

7. The printer of claim 1, further comprising an elongated guide having a scan axis, to which said body is mounted for movement along said scan axis of said elongated guide.

* * * * *